US006854144B1

(12) United States Patent
Mehring, Jr.

(10) Patent No.: US 6,854,144 B1
(45) Date of Patent: Feb. 15, 2005

(54) THERAPEUTIC MATTRESS SYSTEM

(76) Inventor: Samuel S. Mehring, Jr., 3101-A El Prado Blvd., Tampa, FL (US) 33629

( * ) Notice: Subject to any disclaimer, the term of this patent is extended or adjusted under 35 U.S.C. 154(b) by 0 days.

(21) Appl. No.: 10/732,786

(22) Filed: Dec. 11, 2003

(51) Int. Cl.[7] ..... A47C 27/14
(52) U.S. Cl. ..... 5/727; 5/729; 5/722
(58) Field of Search ..... 5/727, 729, 722, 5/731

(56) References Cited

U.S. PATENT DOCUMENTS 2,192,601 A * 3/1940 Mattison ..... 5/729
2,462,579 A * 2/1949 Warner ..... 5/722
2,604,642 A * 7/1952 Marco ..... 5/727
3,987,507 A * 10/1976 Hall ..... 5/653
4,571,763 A * 2/1986 Suzuyama et al. ..... 5/653
4,628,557 A * 12/1986 Murphy ..... 5/723
4,706,313 A * 11/1987 Murphy ..... 5/722
5,369,824 A * 12/1994 Powell ..... 5/735
5,400,449 A * 3/1995 Satto ..... 5/631
6,581,229 B2 * 6/2003 Bernstein ..... 5/722
2004/0172762 A1 * 9/2004 Lenyo ..... 5/655

* cited by examiner

*Primary Examiner*—Robert G. Santos
(74) *Attorney, Agent, or Firm*—Edward P. Dutkiewicz

(57) ABSTRACT

A generally rectilinear block is made of an elastomer. The block has a horizontal top surface, a parallel bottom surface and a vertical peripheral surface. The block has an upper edge, a lower edge and parallel side edges. The block also has a height, and width and a thickness. A plurality of apertures are cut into the block. A plurality of inserts is fabricated of the same material as the block and of a size and shape corresponding to the size and shape of the apertures.

5 Claims, 2 Drawing Sheets

FIG 1
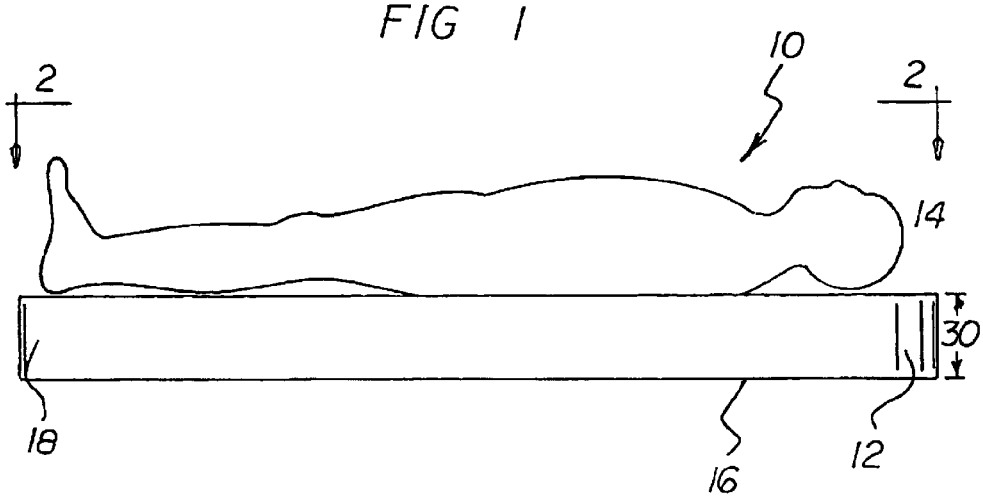
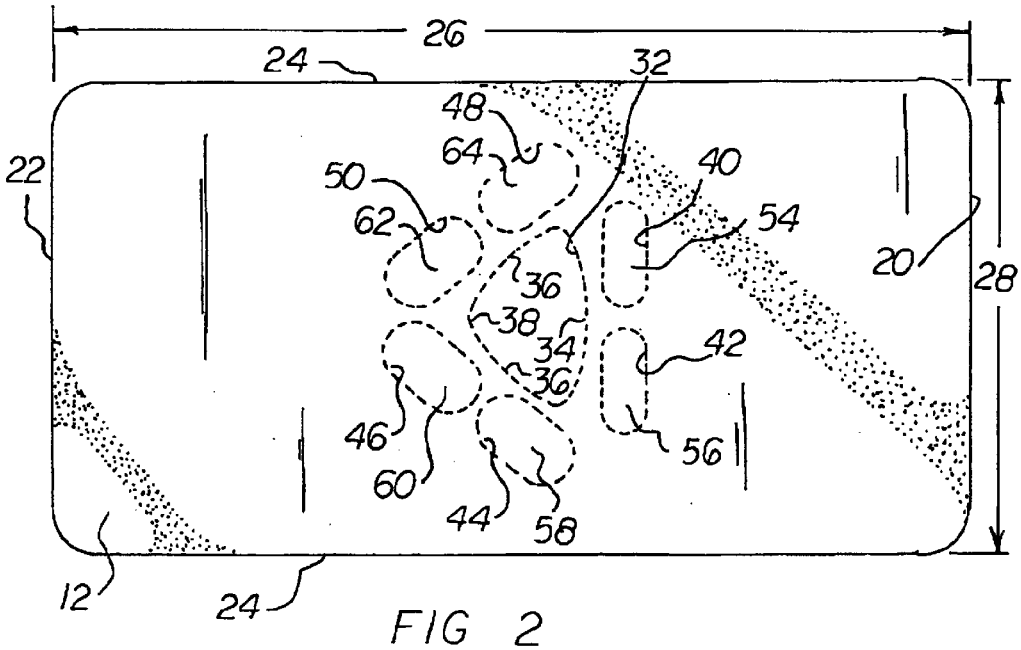
FIG 2

FIG 3
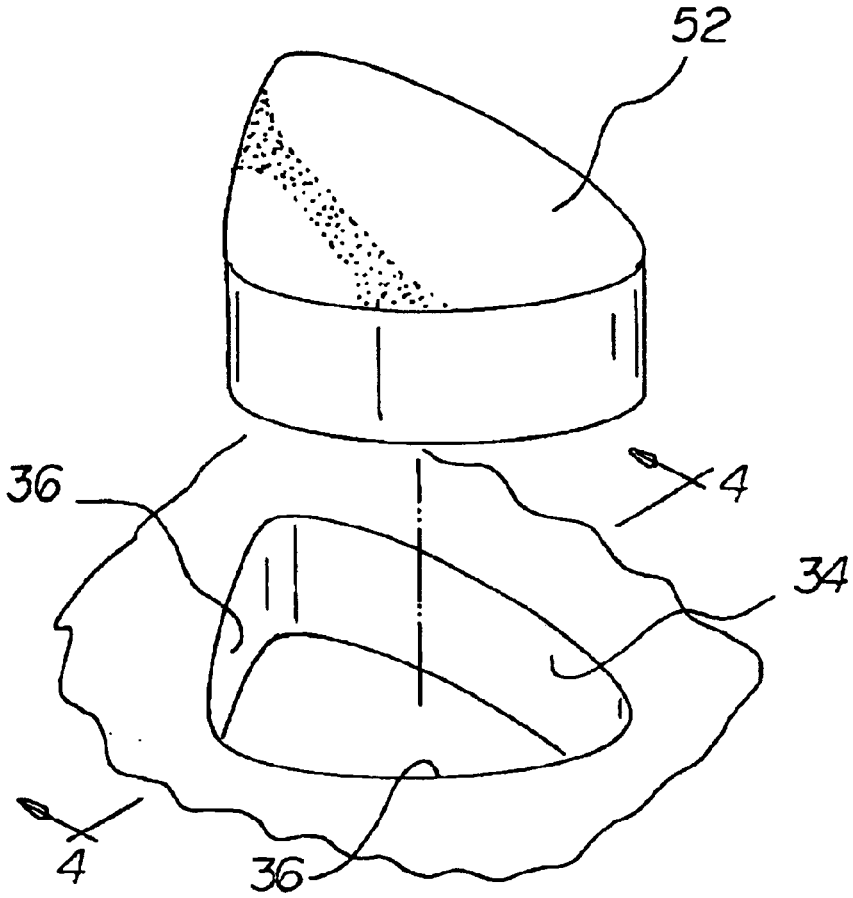
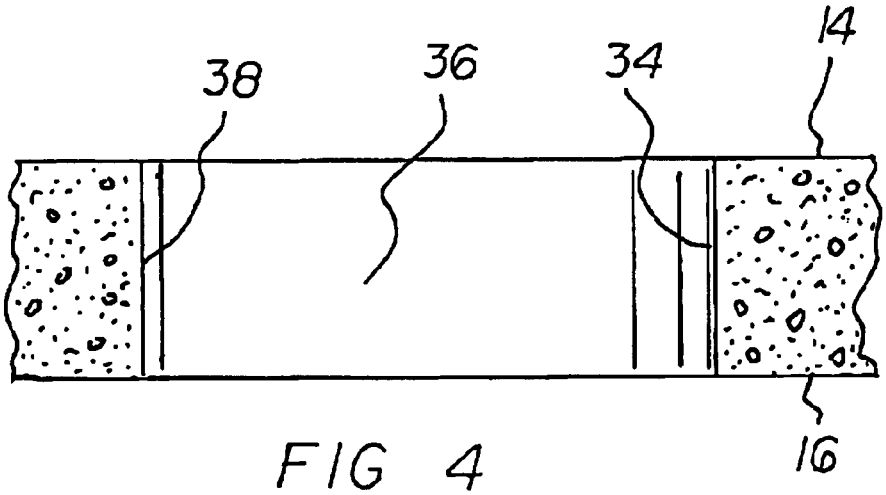
FIG 4

THERAPEUTIC MATTRESS SYSTEM

BACKGROUND OF THE INVENTION

1. Field of the Invention

The present invention relates to a therapeutic mattress system and more particularly pertains to strategically creating holes for pressure relief purposes.

2. Description of the Prior Art

The use of cushioning devices of known designs and configurations is known in the prior art. More specifically, cushioning devices of known designs and configurations previously devised and utilized for the purpose of cushioning a user through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,742,186 issued Jan. 7, 1930 to Claus relates to a cushion. U.S. Pat. No. D411,933 issued Jul. 13, 1999 to Bernstein relates to a modular maternity mattress system. Lastly, U.S. Pat. No. 6,523,198 issued Feb. 25, 2003 to Temple relates to a modular medical-bed mattress with underlying bed pan.

While these devices fulfill their respective, particular objectives and requirements, the aforementioned patents do not describe therapeutic mattress system that allows strategically creating holes for pressure relief purposes.

In this respect, the therapeutic mattress system according to the present invention substantially departs from the conventional concepts and designs of the prior art, and in doing so provides an apparatus primarily developed for the purpose of strategically creating holes for pressure relief purposes.

Therefore, it can be appreciated that there exists a continuing need for a new and improved therapeutic mattress system which can be used for strategically creating holes for pressure relief purposes. In this regard, the present invention substantially fulfills this need.

SUMMARY OF THE INVENTION

In view of the foregoing disadvantages inherent in the known types of cushioning devices of known designs and configurations now present in the prior art, the present invention provides an improved therapeutic mattress system. As such, the general purpose of the present invention, which will be described subsequently in greater detail, is to provide a new and improved therapeutic mattress system and method which has all the advantages of the prior art and none of the disadvantages.

To attain this, the present invention essentially comprises a generally rectilinear bloc. The block is made of an elastomer. The elastomer is selected from a class of elastomers. The class of elastomer includes rubber and plastic, natural and synthetic, and blends of rubber and plastic. The elastomer is preferably a closed cell polyurethane foam. The block has a horizontal top surface, a parallel bottom surface and a vertical peripheral surface between the top and bottom surfaces. The block has an upper edge, a lower edge and parallel side edges between the upper and lower edges. The block also has a height, a width, and a thickness. The height is between about 175 and 225 percent of the width. The width is between about 500 and 700 percent of the thickness.

A plurality of apertures are provided. The apertures are cut into the block. The apertures include a central aperture.

The central aperture is in the general configuration of an isosceles right triangle with slightly curved sides. The sides of the triangle include a base side. The base side is located midway between the side edges and closer to the upper edge than to the lower edge. The base side is between about 30 and 40 percent of the width of the block. The sides of the triangle also include two leg sides. An apex is located midway between the side edges and closer to the lower edge than to the upper edge.

The apertures also include a plurality of ovals. Each of the ovals has a long major axis and a short minor axis. The ovals are arranged in pairs. One pair of ovals has its major axes aligned in proximity to the base side of the triangle. Each of the other two pairs of ovals have their major axes aligned in proximity to the leg sides of the triangle respectively. In this manner the major axes of the three pairs of the ovals form an isosceles triangle around. The isosceles triangle is congruent with, the isosceles right triangle of the central aperture. Each aperture has vertical sides. The vertical sides extend between the top and bottom surfaces. At least 30 percent of the block, measured from the upper edge, is devoid of apertures. At least 30 percent of the block, measured from the lower edge, is devoid of apertures.

Provided last is a plurality of inserts. The inserts are fabricated of the same material as the block. The inserts are of a size and shape corresponding to the size and shape of the apertures. In this manner each aperture may be selectively filled with an insert so that all of the apertures may be simultaneously filled for maximizing pressure on a user. In the alternative, none of aperture may be filled with an insert for minimizing pressure on a user. In the alternative, preselected apertures may be selectively filled with inserts at the discretion of the user for the selective application of pressure.

There has thus been outlined, rather broadly, the more important features of the invention in order that the detailed description thereof that follows may be better understood and in order that the present contribution to the art may be betters appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved therapeutic mattress system which has all of the advantages of the prior art cushioning devices of known designs and configurations and none of the disadvantages.

It is another object of the present invention to provide a new and improved therapeutic mattress system which may be easily and efficiently manufactured and marketed.

It is further object of the present invention to provide a new and improved therapeutic mattress system which is of durable and reliable constructions.

An even further object of the present invention is to provide a new and improved therapeutic mattress system which is susceptible of a low cost of manufacture with regard to both materials and labor, and which accordingly is then susceptible of low prices of sale to the consuming public, thereby making such therapeutic mattress system economically available to the buying public.

Even still another object of the present invention is to provide a therapeutic mattress system for strategically creating holes for pressure relief purposes.

Lastly, it is an object of the present invention to provide a new and improved therapeutic mattress system. A generally rectilinear block is made of an elastomer. The block has a horizontal top surface, a parallel bottom surface and a vertical peripheral surface. The block has an upper edge, a lower edge and parallel side edges. The block also has a height, a width and a thickness. A plurality of apertures are cut into the block. A plurality of inserts is fabricated of the same material as the block and of a size and shape corresponding to the size and shape of the apertures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a therapeutic mattress system constructed in accordance with the principles of the present invention.

FIG. 2 is a plan view of the system taken along line 2—2 of FIG. 1.

FIG. 3 is an exploded perspective illustration of a portion of the system with a central insert being removed from the system.

FIG. 4 is a cross sectional view taken along line 4—4 of FIG. 3.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved therapeutic mattress system embodying the principles and concepts of the present invention and generally designated by the reference numeral 10 will be described.

The present invention, the therapeutic mattress system 10 is comprised of a plurality of components. Such components in their broadest context include a generally rectilinear block, a plurality of inserts and a plurality of apertures. Such components are individually configured and correlated with respect to each other so as to attain the desired objective.

First provided is a generally rectilinear block 12. The block is made of an elastomer. The elastomer is selected from a class of elastomers. The class of elastomer includes rubber and plastic, natural and synthetic, and blends of rubber and plastic. The elastomer is preferably a closed cell polyurethane foam. The block has a horizontal top surface 14, a parallel bottom surface 16 and a vertical peripheral surface 18 between the top and bottom surfaces. The block has an upper edge 20, a lower edge 22 and parallel side edges 24 between the upper and lower edges. The block also has a height 26, a width 28, and a thickness 30. The height is between about 175 and 225 percent of the width. The width is between about 500 and 700 percent of the thickness.

A plurality of apertures are provided. The apertures are cut into the block. The apertures include a central aperture 32. The central aperture is in the general configuration of an isosceles right triangle with slightly curved sides. The sides of the triangle include a base side 34. The base side is located midway between the side edges and closer to the upper edge than to the lower edge. The base side is between about 30 and 40 percent of the width of the block. The sides of the triangle also include two leg sides 36. An apex 38 is located midway between the side edges and closer to the lower edge than to the upper edge.

The apertures also include a plurality of ovals 40, 42, 44, 46, 48, 50. Each of the ovals has a long major axis and a short minor axis. The ovals are arranged in pairs. One pair of ovals 40, 42 has its major axes aligned in proximity to the base side of the triangle. Each of the other two pairs of ovals 44, 46 and 48, 50 have their major axes aligned in proximity to the leg sides of the triangle respectively. In this manner the major axes of the three pairs of the ovals form an isosceles triangle around. The isosceles triangle is congruent with, the isosceles right triangle of the central aperture. Each aperture has vertical sides. The vertical sides extend between the top and bottom surfaces. At least 30 percent of the block, measured from the upper edge, is devoid of apertures. At least 30 percent of the block, measured from the lower edge, is devoid of apertures.

Provided last is a plurality of inserts 52, 54, 56, 58, 60, 62, 64. The inserts are fabricated of the same material as the block. The inserts are of a size and shape corresponding to the size and shape of the apertures. In this manner each aperture may be selectively filled with an insert so that all of the apertures may be simultaneously filled for maximizing pressure on a user. In the alternative, none of aperture may be filled with an insert for minimizing pressure on a user. In the alternative, preselected apertures may be selectively filled with inserts at the discretion of the user for the selective application of pressure.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A therapeutic mattress system for strategically creating holes for pressure relief purposes comprising, in combination:

a generally rectilinear block of an elastomer selected from a class of elastomers including rubber and plastic, natural and synthetic, and blends thereof, the block having a horizontal top surface and a parallel bottom surface and a vertical peripheral surface therebetween, the block having an upper edge and a lower edge and parallel side edges therebetween, the block also having a height and a width and a thickness, the height being between about 175 and 225 percent of the width and the width being between about 500 and 700 percent of the thickness;

a plurality of apertures cut into the block, the apertures including a central aperture in the general configuration of an isosceles right triangle with slightly curved sides, the sides of the triangle including a base aide located midway between the side edges and closer to the upper edge than to the lower edge, the base side being between about 30 and 40 percent of the width of the block, the sides of the triangle also including two leg sides with an apex-located midway between the side edges and closer to the lower edge than to the upper edge;

the apertures also including a plurality of ovals each of the ovals having a long major axis and a short minor axis, the ovals being arranged in pairs with one pair of ovals having their major axes aligned in proximity to the base side of the triangle and with each of the other two pairs of ovals having their major axes aligned in proximity to the leg sides of the triangle respectively whereby the major axes of the three pairs of the ovals form an isosceles triangle around, and congruent with, the isosceles right triangle of the central aperture, each aperture having vertical sides extending between the top and bottom surfaces, at least 30 percent of the block measured from the upper edge being devoid of apertures, at least 30 percent of the block measured from the lower edge being devoid of apertures; and a plurality of inserts fabricated of the same material as the block and of a size and shape corresponding to the size and shape of the apertures, whereby each aperture may be selectively filled with an insert so that all of the apertures may be simultaneously filled for maximizing pressure on a user, and, in the alternative, none of the apertures may be filled with an insert for minimizing pressure on a user, and, in the alternative, preselected apertures may be selectively filled with inserts at the discretion of the user for the selective application of pressure.

2. A therapeutic mattress system comprising:

a generally rectilinear block of an elastomer having a horizontal fat top surface and a parallel flat bottom surface and a vertical peripheral surface therebetween, the block having an upper edge and a lower edge and parallel side edges therebetween, the block also having a height and a width and a thickness;

a plurality of apertures substantially noncircular of a plurality of sizes and shapes cut through the block and extending from said top surface to said bottom surface; and a plurality of inserts fabricated of the same material as the block and of a size and shape corresponding to the size and shape of the apertures each of the inserts having a flat and a parallel flat bottom.

3. The system as set forth in claim 2 wherein the apertures include a central aperture in the general configuration of an isosceles right triangle and a plurality of ovals having a long major axis and a short minor axis, the ovals being arranged in pairs with one pair of ovals having their major axes aligned in proximity to the base side of the triangle and with each of the other two pairs of ovals having their major axes aligned in proximity to the leg sides of the triangle respectively, each aperture having vertical sides extending between the top and bottom surfaces.

4. The system as set forth in claim 2 wherein at least 30 percent of the block measured from the upper edge being devoid of apertures and at least 30 percent of the block measured from the lower edge being devoid of apertures.

5. The system as set forth in claim 2 wherein each aperture may be selectively filled with an insert so that all of the apertures may be simultaneously filled for maximizing pressure on a user, and, in the alternative, none of the apertures may be filled with an insert for minimizing pressure on a user, and, in the alternative, preselected apertures may be selectively filled with inserts at the discretion of the user for the selective application of pressure.

* * * * *